US005854644A

United States Patent [19]

Eun

[11] Patent Number: 5,854,644

[45] Date of Patent: Dec. 29, 1998

[54] ELECTROMAGNETIC INK-JET PRINTHEAD FOR IMAGE FORMING APPARATUS

[75] Inventor: Jong-Moon Eun, Suwon, Rep. of Korea

[73] Assignee: SamSung Electronics Co., Ltd., Suwon, Kyungki, Rep. of Korea

[21] Appl. No.: 730,051

[22] Filed: Oct. 15, 1996

[30] Foreign Application Priority Data

Oct. 13, 1995 [KR] Rep. of Korea ..... 35339/1995

[51] Int. Cl.[6] ..... B41J 2/04

[52] U.S. Cl. ..... 347/54; 347/55

[58] Field of Search ..... 347/54, 55, 70

[56] References Cited

U.S. PATENT DOCUMENTS 4,354,197 10/1982 Reitberger ..... 347/55

FOREIGN PATENT DOCUMENTS 2-27241 11/1990 Japan ..... 347/54

*Primary Examiner*—Benjamin R. Fuller
*Assistant Examiner*—Judy Nguyen
*Attorney, Agent, or Firm*—Robert E. Bushnell, Esq.

[57] ABSTRACT

An electromagnetic inkjet printhead for performing a printing operation with unheated ink not heated up improves the image quality. The electromagnetic ink-jet printhead includes a conductive vibration plate formed on one side of an ink chamber of a substrate. A pair of electrodes is formed on both sides of the conductive vibration plate so that an electric current is applied with the electrodes. A magnet is formed on the side of the conductive vibration plate.

7 Claims, 4 Drawing Sheets

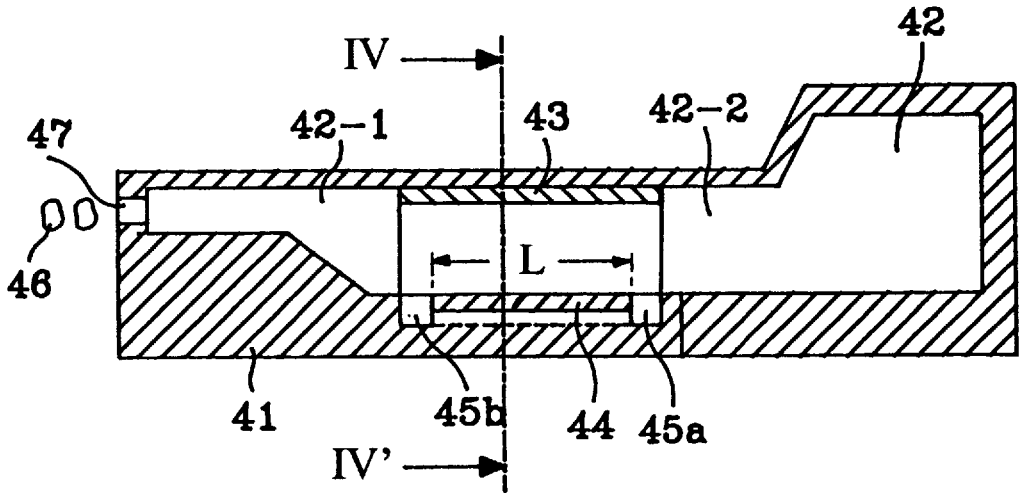
Fig. 4A
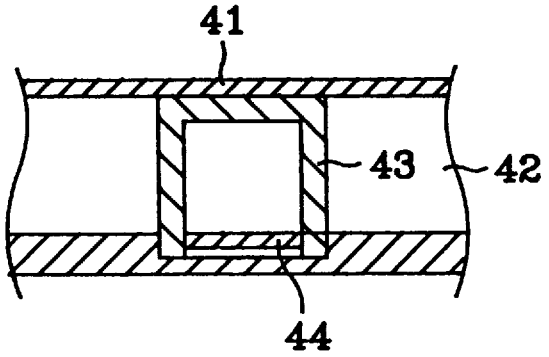
Fig. 4B (SECTION IV-IV')

ELECTROMAGNETIC INK-JET PRINTHEAD FOR IMAGE FORMING APPARATUS

CLAIM OF PRIORITY

This application makes reference to, incorporates the same herein, and claims all benefits accruing under 35 U.S.C. §119 from an application for Electromagnetic Ink-Jet Printhead For Image Forming apparatus earlier filed in the Korean Industrial Property Office on 13th of Oct. 1995 and there duly assigned Ser. No. 35339/1995.

BACKGROUND OF THE INVENTION

1. Field of the Invention

The present invention relates to an image forming apparatus and, more particularly, to an ink-jet printhead for an image forming apparatus.

2. Description of the Related Art

Among image forming apparatuses, there are impact and non-impact printing apparatuses. They, especially the non-impact printing apparatuses, have recently gained in popularity—to wit: laser beam printers, a facsimile systems, and other image forming devices. Among non-impact printing systems, there are thermal printing systems, ink-jet printing systems, and electrophotographic systems. Among ink-jet printing systems, there are thermal ink-jet printing systems and piezo ink-jet printing systems.

A perusal of the contemporary art indicates a further need for ink-jet printing systems. Tsuge et al. (U.S. Pat. No. 4,599,629, Magnetic Ink Dot Printer with Means for Controlling Print Density, Jul. 8, 1986) teaches an ink dot printer including a pair of magnetic pole plates arranged opposite to each other. An electromagnet magnetizes the paired magnetic pole plates to introduce magnetic ink film therein. Magnetic ink is forced onto a recording paper. Berkowitz (U.S. Pat. No. 4,328,503, High Resolution magnetic Printing Head, May 4, 1982) discusses a high resolution magnetic printing head with electrically conductive signal lines. High permeability magnetic material is deposited between some of the signal lines by electrodeposition so as to form magnetic pole pieces between conductors. Sekine et al. (U.S. Pat. No. 4,258,371, Image Recording apparatus, Mar. 24, 1981) discusses an array of opposite electrodes each of which is disposed opposite to a plurality of styli. The styli can be made of magnetic material. Zenner (U.S. Pat. No. 4,023,180, Dot Printer with Electrically Propelled Ink, May 10, 1977) teaches a print head for a dot matrix printer which prints dots by electrically propelling droplets of ink onto a record. The print head of Zenner comprises an kink chamber, ink tubes, and a pair of electrodes. A magnetic field causes a droplet of ink to be propelled outwardly from each ink tube whenever the electrodes for that tube are energized. Ichioka et al. (U.S. Pat. No. 3,787,879, Magnetic Ink Recording System, Jan. 22, 1974) discusses a recording of magnetic ink on a continuous moving recording paper inserted between a magnetic ink supply nozzles and opposed magnetic heads. The recording uses a magnetic field. From a reading of the this exemplary, I find that there is a need for ink-jet printing systems that effectively uses electromagnetic forces in printing. Further, I have found that there is a need for improving the image quality without using special ink. An ink with special thermal and chemical properties can be expensive or even can be difficult to obtain. Also, I have noticed that there is a need to prevent cavitation and its entailing corrosion on nozzles and electrodes of a printing system. This is to prolong a lifetime of an image forming apparatus. In addition, there are needs to simplify the structure of the product and to facilitate mass production of the product.

SUMMARY OF THE INVENTION

It is therefore an object of the present invention to provide an improved ink-jet printing system.

It is another object to provide an electromagnetic ink-jet printhead for performing a printing operation without heating ink.

It is yet another object to a provide a cost effective electromagnetic ink-jet print head by separately providing an ink cartridge that would permit replacement of ink.

It is still another object to provide an electromagnetic ink-jet print head in which a conductive vibration plate itself is vibrated by an electric current.

In order to accomplish at least one of the above objects, the present invention provides an electromagnetic ink-jet printhead for an image forming apparatus including a conductive vibration plate formed on one side of an ink chamber of a substrate. A pair of electrodes is formed on both sides of the conductive vibration plate so that an electric current is applied with the electrodes. A magnet formed on the side of the conductive vibration plate. The ink is jetted out through an ejection hole formed on one end of ink chamber. The present invention can be achieved using a permanent magnet to form a magnet field. The magnetic field is to be perpendicular to the current flowing through the conductive vibration plate. The conductive vibration plate can be a thin plate.

BRIEF DESCRIPTION OF THEE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein:

FIG. 4A depicts an electromagnetic ink-jet printhead built according to the principles of the present invention;

FIG. 4B is a side-sectional view of FIG. 4A taken along sectional line VI–IV')

DETAILED DESCRIPTION OF THE PREFERRED EMBODIMENT

Figure 1:
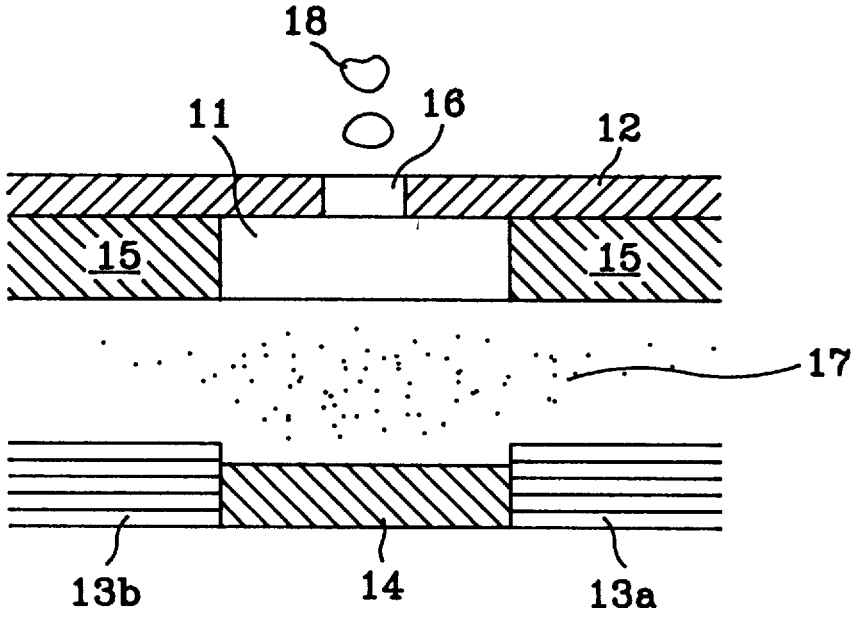
FIG. 1 illustrates a ink-jet printhead.

Referring now to the drawings, a non-impact, thermal ink-jet printing system is shown in FIG. Such a system is typical and can be found in typical printer such as the printers manufactured by Hewlett-Packard or CANON. As shown in FIG. 1, a thermal ink-jet printing system is disposed to apply current to electrodes. The system almost instantaneously heats up an ink-particles. Ink bubbles are generated. As the ink bubbles are collapsed, pressure is generated. This pressure enables the ink particles to be jetted out. As patterns of the ink particles hit a paper, characters are formed on the 8 paper. In FIG. 1, a thermal register 14 is disposed between electrodes 13*a* and 13*b*. As the current flows between the electrodes 13*a* and 13*b*, the thermal register 14 gives off heat. This generated heat is transferred to ink 18 contained in an ink chamber 11. The ink jet chamber 11 is formed on a protecting layer 17. A conduction of heat through the protection layer 17 is used in forming the ink chamber 11. To prevent from escaping, a barrier layer 15 serves to block the heat from other areas. Afterwards, the ink 18 in the ink chamber 11 is heated up to generate the ink bubbles. When the ink bubbles grow to over a predetermined size, some of the ink bubbles collapse. The pressure generated from such collapses allows the ink 18 to be discharged through an ejection hole 16 of a nozzle plate 12.

A thermal ink-jet printing system injects ink with the pressure generated upon collapsing the ink bubbles generated by heating the ink. As mentioned previously, this is done with a thermal register. Such a thermal ink-jet printing system requires the ink to be of such composition that the ink is of certain stabilities, being stable thermally and stable chemically. To develop an ink with high stability is difficult. To ensure a long-term reliability of the ink and to keep that reliability upon using the ink for a long time are difficult. Further, the ink bubbles may cause corrosion on the nozzle plate by cavitations that occur when the ink bubbles are collapsed.

Figure 2:
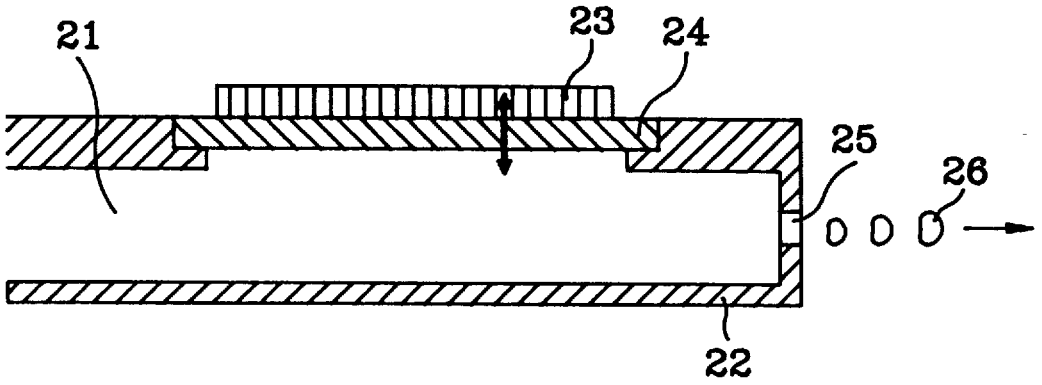
FIG. 2 illustrates another ink-jet printhead.

FIG. 2 illustrates a piezo ink-jet printing system. An example of a piezo inkjet printing system can be found in many printers, such as in one of the EPSON printers. In a piezo ink-jet printing system, a mechanical movement can occur upon application of a voltage of a predetermined level with a lead zirconate titanate (PZT) transducer 23. Upon application of the voltage, a vibration plate 24 vibrates up and down. This vibration of the vibration plate 24 generates a pressure. The pressures allows the ink 26 contained in the ink chamber 21 to be discharged out through an ejection hole 25 of a nozzle plate 22.

A piezo ink-jet printing system changes an electric energy into a mechanical energy and ejects the ink with the pressure generated by vibration of the vibration plate. Such a piezo ink-jet printing system does not lend itself to a highly-integrated mass production. This is due to problems, in among others, in mass production of the printheads. Further, technical difficulties exists on increasing the printhead's ejection velocity. This has given rise to a complication of its structure.

Figure 3:
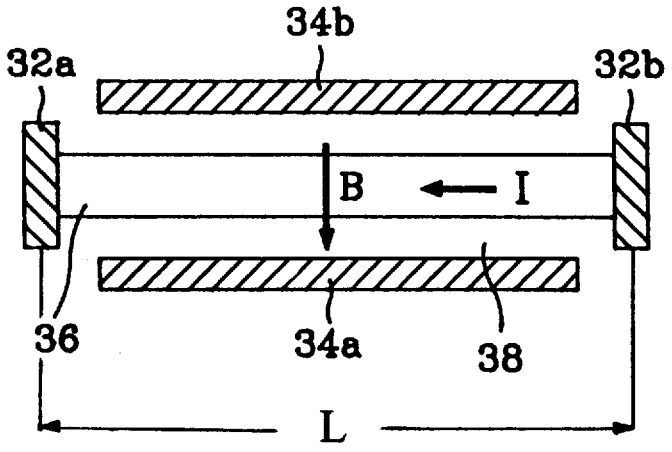
FIG. 3 illustrates a concept of the present invention.

Now, a preferred embodiment of the present invention will in detail be described with reference to the accompanying drawings. FIG. 3 illustrates a concept of the present invention: an electromagnetic ink-jet printhead in accordance to the principles of the present invention. As shown in FIG. 3, a magnetic field 38 enables opposing magnetic films 34*a* and 34*b* having contrary polarities. A conductive vibration plate 36 is disposed to be orthogonal to the magnetic field 38. When an electric current is applied to electrodes 32*a* and 32*b* of the conductive vibration plate 36, a Lorenz force acts on the magnetic field 38 to set up vibration of the conductive vibration plate 36.

The force (F) generated thereby can be expressed by a following equation:

$$\vec{F}=\vec{I}\times\vec{B}\cdot L$$

In the above equation, the symbol L designates a current which passes through the conductive vibration plate 36; the symbol L designates a length of the conductive vibration plate 36 disposed between the electrodes 32*a* and 32*b*; and the symbol B designates a magnetic field density of the magnetic films 34*a* and 34*b*.

This generated force causes the vibration of the conductive vibration plate 36. This vibration is affected by the magnitude of current, direction of current, intensity of magnetic field and length of the vibration plate. The pressure generated by the vibration of the conductive vibration plate 36 allows the ink to be jetted out.

FIG. 4A depicts an electromagnetic ink-jet printhead in accordance with a preferred embodiment of the present invention. FIG. 4B is a side-sectional view of FIG. 4A taken along sectional line IV—IV'. The print head includes a body 41 with a chamber 42.

A conductive vibration plate 44 is installed at a lower portion of an ink chamber 42. Inside the ink chamber, connection sections 42-1 and 42-2 enables the ink to be supplied from an ink tank (not shown). The connection section 42-1 is connected to a nozzle hole (ejection hole) 47. Electrodes 45*a* and 45*b* are disposed at sides of the conductive vibration plate 44.

Figure 5:
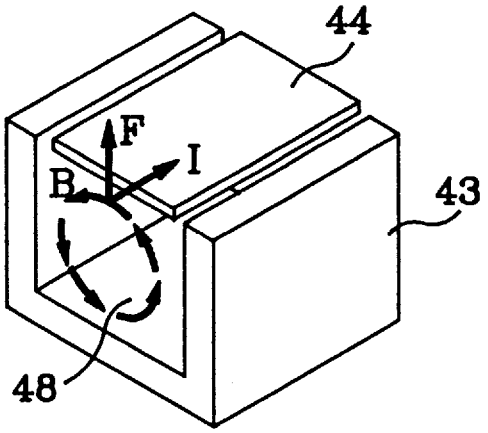
FIG. 5 depicts another electromagnetic ink-jet head built constructed according to the principles of the present invention.

A magnet 43 is mounted so as to be near at least two opposite side portions of the conductive vibration plate 44. The magnetic field 48 is formed in a direction that is perpendicular to the flow of the electric current flowing to the conductive vibration plate 44. Accordingly, the magnet 43 permits the magnetic field 48 to always exist across the conductive vibration plate 44. An electric current is applied to the electrodes 45*a* and 45*b* in the direction of the length of the conductive vibration plate 44 to generate an electromagnetic force. As described in the previous paragraphs, the magnitude of the electromagnetic force can be expressed by the equation: $F=I\cdot B\cdot L$. The symbols of the equation designate as indicated before. As illustrated in FIG. 5, the direction F of the electromagnetic force is perpendicular to B and I. More particularly, the direction of the electromagnetic force is determined by vector product of the current and the magnetic field density. As is illustrated in FIG. 5, a vibration of the conductive vibration plate 44 would affect and would determine the direction of the electromagnetic force. During a use of the printhead, the vibration of the conductive vibration plate 44 is induced and the pressure generated thereby causes the ink 46 to be ejected through the nozzle hole 47.

As mentioned above, the printhead does not use the heated ink of a contemporary practice. The printhead does not demand such great thermal and chemical stability properties of ink. These properties are important properties of ink. Thus, the present invention ensures the enhancement in the image quality without using special ink. Also, the present invention would prolong the lifetime of the printhead. This is different from a piezo ink-jet printing system which uses a lead zirconate titanate (PZT) transducer for each vibration plate. This simplifies the structure of the product and facilitates mass production of the product. The present invention prevents its nozzle and electrodes from being corroded. In addition, the present invention permits the conductive vibration plate itself to vibrate without use of the PZT transducer. The present invention can lower the overall production cost and obtain the simplification of structure.

While there have been illustrated and described what are considered to be preferred embodiments of the present invention, it will be understood by those skilled in the art that various changes and modifications may be made, and equivalents made be substituted for elements thereof without departing from the true scope of the present invention. In addition, many modifications may be made to adapt a particular situation to the teaching of the present invention without departing from the central scope thereof Therefore, it is intended that the present invention not be limited to the particular embodiments disclosed as the best mode contemplated for carrying out the present invention, but that the present invention includes all embodiments falling within the scope of the appended claims.

What is claimed is:

1. An electromagnetic ink-jet printhead for an image forming apparatus, comprising:

a body having an ejection aperture and a chamber accommodating ink, and communicating said ejection aperture said ejection aperture being oriented to eject ink from said chamber, said body comprising:

a conductive vibration plate disposed within said chamber and made of an electrically conductive material, comprising a first side, a second side and a third side and a fourth side, disposed to contact the ink within said chamber;

a first electrode disposed on said first side of said conductive vibration plate;

a second electrode disposed on said second side, opposite to said first side, of said conductive vibration plate for generating, in cooperation with said first electrode, a current through said conductive vibration plate;

a U-shaped magnet disposed near said third side and said fourth side of said conductive vibration plate imparting a magnetic field orthogonal to a direction of said current; and said conductive vibration plate vibrating in response to the generating of said current across said vibration plate and through said magnetic field, resulting in increases in pressure in said chamber, causing the ink to be ejected through said ejection aperture.

2. The printhead according to claim 1, wherein said conductive vibration plate vibrates in response to application of an electrical potential difference across said vibration plate to force the ink to jet through said aperture.

3. The printhead according to claim 1, wherein vibration by said conductive vibration plate increases at said aperture.

4. The printhead according to claim 1, wherein said conductive vibration plate is a thin-film plate.

5. An electromagnetic ink-jet printhead for an image forming apparatus, comprising:

a body having an aperture and a chamber communicating with said aperture and accommodating ink, said body comprising:

a conductive vibration plate disposed within said chamber in contact with the ink and comprising a first end, a second end, and a first side and a second side;

a first electrode disposed at said first end of said conductive vibration plate;

a second electrode disposed at said second end of said conductive vibration plate for generating, in cooperation with said first electrode, a current;

a U-shaped magnet disposed near said first side and said second side of said conductive vibration plate for generating a magnetic field orthogonal to said current; and said conductive vibration plate vibrating in response to the generating of said current across said vibration plate and through said magnetic field, resulting in increases in pressure in said chamber, causing the ink to be ejected through said ejection aperture.

6. The printhead according to claim 5, wherein the pressure in said ink chamber directly depends on a length of said conductive vibration plate.

7. An ink jet printer head for an image-forming apparatus, comprising:

a body having an aperture and a chamber communicating with said aperture and accommodating ink said body comprising;

a conductive vibration plate disposed within said chamber and having a rectangular form, a pair of opposing ends, a first side and a second side, and being made of an electrically-conductive material;

a pair of electrodes to which a current is applied, said electrodes being continually connected to said pair of opposing ends of said conductive vibration plate;

a U-shaped magnet disposed near said first side and said second side of said conductive vibration plate for imparting a magnetic field orthogonal to a direction of the current; and said magnetic field and an electric field generated by the current cooperate to vibrate said conductive vibration plate, increasing pressure in said chamber, and urging ink from said chamber.

* * * * *